US005252941A

United States Patent [19]

Pitzele et al.

[11] Patent Number: 5,252,941

[45] Date of Patent: Oct. 12, 1993

[54] SPIRAL, SELF-TERMINATING COIL AND METHOD OF MAKING THE SAME

[75] Inventors: Lennart D. Pitzele, Rockwall; Matthew A. Wilkowski, Mesquite, both of Tex.

[73] Assignee: AT&T Bell Laboratories, Murray Hill, N.J.

[21] Appl. No.: 989,393

[22] Filed: Dec. 11, 1992

[51] Int. Cl.[5] ..... H01F 15/10; H01F 27/28

[52] U.S. Cl. ..... 336/192; 29/605; 336/223

[58] Field of Search ..... 29/602.1, 604, 605, 29/606; 336/192, 223, 222; 310/71

[56] References Cited

U.S. PATENT DOCUMENTS 217,466 7/1879 Le Conte ..... 336/223
3,546,644 12/1970 Wilburn et al. ..... 336/223
3,771,086 11/1973 Poulsen ..... 336/223
4,146,858 3/1979 McDermott ..... 336/223

*Primary Examiner*—Thomas J. Kozma
*Attorney, Agent, or Firm*—Robert B. Levy

[57] ABSTRACT

A spiral, self-terminating coil (12) is formed of an elongated metallic member (10) having at least a first and second tabs (22,23) extending out from a separate one of the ends (18,20) of the member such that each tab is perpendicular to the axis of the member. At least one notch (26) is provided in the member (10) intermediate the tabs and parallel thereto. Each notch (26) is located so that when the member is wound in the spiral, the notches are aligned with the tab inside of the spiral. The inside tab can thus be oriented perpendicular to the spiral turns so as to extend through the notches beyond the spiral.

11 Claims, 1 Drawing Sheet

SPIRAL, SELF-TERMINATING COIL AND METHOD OF MAKING THE SAME

TECHNICAL FIELD

This invention relates to a spiral, self-terminating electrical coil and a method of making the same.

BACKGROUND OF THE INVENTION

In the design of electrical circuits, there is often a need to provide electrical reactance in the circuit. Such reactance is usually provided by way of a magnetic device, such as an inductor, comprised of one or more windings of an electrical conductor, (i.e., a wire or strip of metal). When the inductor must carry high currents, as is common in power supply circuits, the resistance of the inductor should be minimized, typically by increasing the cross-sectional area of the conductor which forms the windings. Minimizing the inductor resistance is even more important when the constraint of reduced size is imposed.

The cross-sectional area of each winding can be maximized by constructing the inductor of a flat metallic strip wound in a spiral. The problem associated with constructing an inductor in this fashion is bringing the inner end of the inductor outside the spiral in order to make an electrical connection therewith, while minimizing loss of the conductor cross-sectional area. One possible solution to this problem is disclosed in U.S. Pat. No. 4,959,630, issued in the names of A. J. Yerman et al., which describes a spiral coil formed of a metallic conductor laminated to a pliable dielectric material. The metallic conductor is patterned in a continuous chain of undulating, end-to-end semicircles.

It is believed that there are several disadvantages in the approach proposed by Yerman et al. First, the inductor of Yerman et al. is not wound, but rather, is formed by folding each semicircle over another in an accordion-like fashion so that a small amount of winding volume is lost in each fold. Moreover, the conductor of the Yerman et al. inductor patent is believed to be constrained to thickness on the order of about three mils ($76.2\mu$). For high-frequency operation, such a conductor thickness is probably sufficient because the conductivity is limited by the skin-depth effect. However, at lower frequency operation, a greater conductor thickness is probably necessary.

Another possible solution to the problem of how to bring the inner spiral end out from the coil is to attach a terminal to both ends of the coil. The addition of such a terminal adds to the fabrication cost of the device and causes a decrease in the conductivity of the windings at the junction with the terminal. Such a conductivity decrease is attributable to the fact that solder is less conductive than the copper typically used to form the windings.

There is a need for a spiral coil which avoids the disadvantages of the prior art.

SUMMARY OF THE INVENTION

Briefly, in accordance with the invention, there is provided a self-terminating spiral coil which is comprised of an elongated metallic member, typically in form of a strip, having first and second ends. The member is provided with at least first and second tabs, each extending out from a separate one of the first and second member ends so as to be generally parallel to the other tab. At least one notch is provided in the member in between the ends and oriented parallel to the first and second tabs. The member is wound in a spiral having at least one turn such that the first end of the member lies inside the second end and each notch in the member is aligned with the first tab. When the first tab is oriented so as to be perpendicular to each winding of the spiral, the tab will be received in the notches to enable the tab to extend out from the spiral perpendicular to the spiral turns but be isolated therefrom.

DETAILED DESCRIPTION

Figure 1:
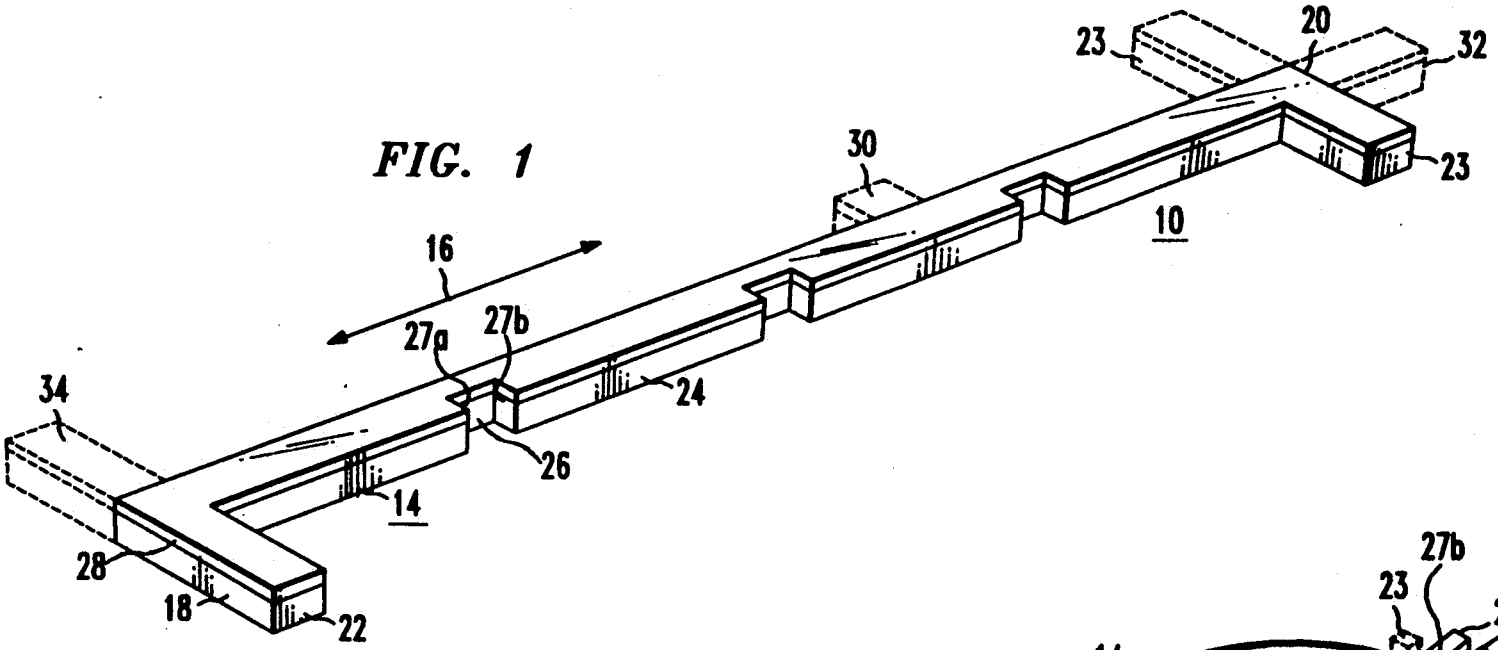
FIG. 1 is a perspective view of a metallic member in accordance with the invention for forming a spiral, self-terminating coil.
Figure 2:
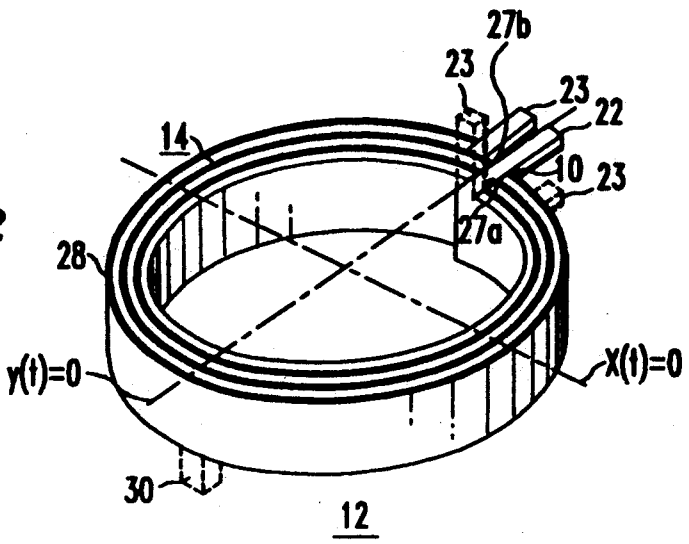
FIG. 2 is a perspective view of a spiral, self-terminating coil in accordance with the invention, formed from the member of FIG. 1.

Referring to FIG. 1, there is shown a metallic member 10, in accordance with the invention, which, when wound in a spiral, yields the coil 12 of FIG. 2. The metallic member 10 comprises an elongated metal strip 14, typically etched or stamped from a ribbon of copper or the like so as to have a longitudinal axis parallel to arrow 16. The strip 14 has first and second ends 18 and 20. A first and and a second tab 22 and 23 are each formed integral with the strip 14 at a separate one of the first and second ends 18 and 20, respectively, so as to extend outwardly from a first face 24 of the strip in a direction perpendicular to the axis 16.

The face 24 of the strip 14 has at least one, and preferably a plurality of notches 26 therein in between the tabs 22 and 23. Each notch 26 has a first and second sidewall **27*a* and 27*b*, respectively, spaced apart a distance slightly greater than the width of the tab 22. In the illustrated embodiment of FIG. 1, the strip face 24 is provided with three notches 26. The number of the notches is dependent on the number of turns of the spiral coil 12 of FIG. 2, as will be discussed below. The depth of each notch 26 is at least as great as the thickness of the tab 22**.

Conformally coating one surface of the strip 14 (including both of the tabs 22 and 23) is a dielectric layer 28. In practice, the dielectric layer 28 is formed of an insulative material, such as polyimide. Other types of dielectric materials, such as paper or the like, are equally useful. When the member 10 is tightly wound to form the spiral coil 12 of FIG. 2 such that each turn or winding is contiguous with each succeeding one, the dielectric layer 28 thus electrically isolates each turn from another. The amount of isolation can be increased by conformally coating both the top and bottom surfaces of the member 10 with the dielectric layer 28, as well as by increasing the layer thickness. The dimensions of the dielectric layer 28 can also be enlarged so that it is bigger than the member 10. Note that the spiral coil 12 could be loosely wound such that each turn is spaced a short distance from each successive turn, allowing the air therebetween to act as a dielectric in place of, or in addition to, the dielectric layer 28.

Referring to FIG. 2, the coil 12 of FIG. 2 is obtained by winding the member 10 in a spiral such that tab 22 lies inside of tab 23. The notches 26 are located in the member 10 so as to be aligned with the tab 22 when the member is wound in the spiral 12. For each complete turn in the spiral coil 12, there must be at least one notch 26.

As may be appreciated from FIG. 2, the purpose in providing the member 10 with each of the notches 26 is to enable the tab 22, when folded 90° from its original orientation (as shown in dashed lines), to be brought out from the inside of the spiral coil 12 across the turns thereof in a direction perpendicular to the spiral turns without any interference therefrom or electrical contact therewith. In this regard, the dielectric layer 28 is located so that when the tab 22 is folded, the layer isolates the tab from the exposed portion of the member 10 in each notch 26. In practice, the tab 23 is likewise folded 90° so as to be in parallel spaced alignment with the tab 22. The purpose in folding each of the tabs 22 and 23 is allow the spiral coil 12, when oriented upside down from the orientation shown in FIG. 2, to be mounted on the surface of a printed circuit board (not shown).

The exact location of the notches 26 in the member 10 can be calculated using parametric equations for a spiral and for lines, while taking into account the specific geometries of the member and the resultant spiral coil 12 formed thereby, as well as the requisite clearance of the notches themselves. An example of how the location of the notches 26 can be determined is set forth below, assuming the following parameters have the listed values:

nturns (the number of winding turns)=3

$\phi$C (the maximum core inside diameter, inches)=0.252 c (clearance of first winding to the core inside diameter, inches)=0 g1 (the location of the first sidewall 27*a* of each notch 26, as measured from a first line y(t)=0 in FIG. 2)=0 g2 (the location of a the second sidewall 27*b* of each notch 26, as measured from the line y(t), in inches)=−0.85 dR increase in the turn radius per revolution, inches)=0.02

The first step in the calculation is to determine the value (Ri) of the initial turn radius. The value of Ri can be established from the relationship:

$$Ri = \frac{\phi C + c}{2} \tag{1}$$

Next, the parametric space for t, the path of the spiral coil 12, is defined in accordance with the relationship:

$$t = 0, \frac{\pi}{8} \ldots 2 \cdot \pi \cdot nturns \tag{2}$$

Having defined t, the parametric space for the spiral 12, it is useful establish two parametric functions x(t) and y(t) in accordance with the relationships:

$$x(t) = \left(Ri + dR \cdot \frac{t}{2 \cdot \pi}\right) \cdot \cos(t) \tag{3}$$

and $$y(t) = \left(Ri + dR \cdot \frac{t}{2 \cdot \pi}\right) \cdot \sin(t) \tag{4}$$

With (t) and y(t) now established, each of a pair of parametric equations can be established for a separate one of a pair of parallel lines y1(t) and y2(t) (not shown) which cut the spiral in parallel spaced relationship. The lines y1(t) and y2(t) are established in accordance with the notch sidewall 27*a* and 27*b* locations as follows:

$$y1(t) = g1 \tag{5}$$

and $$y2(t) = g2 \tag{6}$$

By solving for the intersection of each of the lines y1(t) and y2(t) and the spiral t in the region where x>0, the notch 26 sidewall 27*a* and 27*b* locations can be calculated.

To facilitate such a calculation, it is useful to define a vector of initial guesses for the numerical calculations which are likely to lie closest to $t=2n\pi$ where n=1,2,3. . . Such a vector can be expressed as:

$$s = 2 \cdot \pi, 4 \cdot \pi \ldots 2 \cdot nturns \cdot \pi \tag{7}$$

Next, the points of intersection of y and y1 are determined from the relationship:

$$\left(Ri + dR \cdot \frac{s}{2 \cdot \pi}\right) \cdot \sin(s) = g1 \tag{8}$$

subject to the constraint:

$$x(s) > 0 \tag{9}$$

The initial guess vector s is input to an iterative numerical solving algorithm, as is known in the art, to produce an out solution vector v1(s). The solution vector v1(s) for the case where n=3 is:

| v1(s) |
|---|
| 6.283 |
| 12.566 |
| 18.85 |

Each component of the vector v1(s) defines the location, in radians, of the first sidewall 27*a* of each notch 26.

The points of intersection of y and y2 are given by the relationship:

$$\left(Ri + dR \cdot \frac{s}{2 \cdot \pi}\right) \cdot \sin(s) = g2 \tag{11}$$

subject to the constraint:

$$x(s) > 0 \tag{12}$$

The solution vector for the case where n=3 is:

| v2(s) |
|---|
| 5.652 |
| 12.023 |
| 18.371 |

(13)

defining the locations, as measured in radians, of the second sidewall 27*b* of each notch 26.

To obtain the notch sidewall locations from a start point (the member end 18) to each point in the solution vector v1 and v2, the length of the spiral must be calculated by integrating the parametric equations x(t) and y(t) over the appropriate length of the spiral. The total length of the spiral is given by:

$$L = \int_0^{2 \cdot nturns \cdot \pi} \sqrt{\left(\frac{d}{dt}x(t)\right)^2 + \left(\frac{d}{dt}y(t)\right)^2}\, dt \quad (14)$$

The actual distances, defined in terms of the vector L1(s), for the first notch sidewall 27*a* of each notch 26 are given by the relationship:

$$L1(s) = \int_0^{v1(s)} \sqrt{\left(\frac{d}{dt}x(t)\right)^2 + \left(\frac{d}{dt}y(t)\right)^2}\, dt \quad (15)$$

yielding the values:

(16)

| L1(s) |
|---|
| 0.855 |
| 1.835 |
| 2.941 |

Similarly, the actual distances L2(s) of each second notch sidewall 27*b* is calculated from the relationship $$L2(s) = \int_0^{v2(s)} \sqrt{\left(\frac{d}{dt}x(t)\right)^2 + \left(\frac{d}{dt}y(t)\right)^2}\, dt \quad (17)$$

yielding the values:

(18)

| L2(s) |
|---|
| 0.763 |
| 1.745 |
| 2.852 |

As may be appreciated, the locations of the sidewalls 27*a* and 27*b* of each notch 26 depend on a number of different parameters and the above calculations are by way of example only.

The spiral coil 12, described above, is obtained by configuring the member 10 of FIG. 1 such that the tabs 22 and 23 extend outwardly from the face 24 in the same direction. We have found it desirable, in some instances, to configure the member 10 such that the tab 23 extends outwardly therefrom in the opposite direction (as shown by dashed lines in FIG. 1). Thus, when the member 10 is wound in the spiral 12 shown in FIG. 2, the tabs 22 and 23 will lie in vertical spaced relation (the lower tab 23 being shown in dashed lines in FIG. 2), which facilitates handling of the spiral.

In some instances, it may be desirable to provide the member 10 of FIG. 3 with a third tab 30 (shown in dashed lines) intermediate the tabs 22 and 23, and extending out from the member in a direction opposite the tab 22. The third tab 30 facilitates soldering of the spiral 12 to a circuit board (not shown).

To facilitate winding of the spiral 12 of FIG. 2 it may be desirable to configure the member 10 of FIG. 1 with an additional pair of tabs 32 and 34 (both shown in dashed lines). The tab 32 extends out from the end 20 of the member 10 parallel to the axis 16, whereas the tab 34 extends out from the member perpendicular to the axis in a direction opposite to the tab 22. When the tabs 32 and 34 are provided, the spiral 12 is typically wound by first clamping the tab 34 in an arbor (not shown) whereas the tab 32 is clamped to a tensioning device (not shown). The member 10 is then wound around the arbor. The tab 23 is then folded over so as to be received in the notches 26 in the manner described previously. Following winding of the spiral 12 of FIG. 2, the tabs 32 and 34 are trimmed off.

The foregoing describes a spiral, self-terminating coil 12 wound from a metallic member 10 having a plurality of notches 26 each aligned to receive a tab 22 inside the coil. When the tab 22 is oriented perpendicular to the coil turns, the tab can thus be brought out from inside the coil so as to be received in the notches 26 without any interference with the coil windings.

It is to be understood that the above-described embodiments are merely illustrative of the principles of the invention. Various modifications and changes may be made thereto by those skilled in the art which will embody the principles of the invention and fall within the spirit and scope thereof. For example, while only a single-winding coil 12 has been disclosed, it should be understood that a multi-winding coil, in the form of a transformer, can be realized. Further, while the spiral coil 12 of the invention has been described as having two terminals in the form of tabs 22 and 23, additional terminals are indeed possible.

Claims:

1. A spiral coil comprising:
   - an elongated metallic member having first and second ends lying along a first axis;
   - first and second tabs, each extending out from a separate one of the first and second ends of the member parallel to the other tab and perpendicular to the first axis;
   - at least one notch provided in the member between the first and second ends parallel to each tab;
   - the member being wound in a spiral having at least one turn such that the first tab lies inside the spiral;
   - each notch being spaced along the member such that when the member is wound in a spiral, each notch is aligned with the first tab; and
   - the first tab being oriented so as extend radially outward from the spiral, through each notch, in a direction generally orthogonal to each turn of the spiral.

2. The coil according to claim 1 wherein the second tab extends out from the member in a direction opposite to the first tab.

3. The coil according to claim 1 wherein the second tab extends out from the member in the same direction as the first tab.

4. The coil according to claim 1 wherein the member has a conformal dielectric on one of its major surfaces.

5. The coil according to claim 4 wherein the coil turns are contiguous to each other but electrically isolated by the dielectric.

6. The coil according to claim 1 wherein the metallic member is made of copper.

7. The coil according to claim 4 wherein the dielectric is made of polyimide.

8. The coil according to claim 1 further including a third tab extending out from the member intermediate the first and second tabs.

9. A method of making a self-terminating spiral coil comprising the steps of:
   - providing an elongated metallic member having a first axis such that the member has at least first and a second tabs, each extending out from the member from a separate one of the ends thereof so as to be perpendicular to the axis;

providing at least one notch in the member parallel to each tab;

winding the member in a spiral having at least one turn such that the first tab lies inside the spiral and each notch is aligned with the first tab; and orienting the first tab so that the tab is received in each notch to enable the first tab to extend out from the spiral generally perpendicular to each turn thereof.

10. The method according to claim 9 further including the step of coating the member with a dielectric layer.

11. The method according to claim 10 wherein the member is wound tightly so that each turn of the spiral is contiguous with each succeeding turn but is isolated therefrom by the dielectric layer.

* * * * *